US006449879B1

(12) United States Patent
Fallon et al.

(10) Patent No.: US 6,449,879 B1
(45) Date of Patent: Sep. 17, 2002

(54) SPORTS SHOE WITH INTEGRAL TONGUE AND LACING SYSTEM

(75) Inventors: Kevin Fallon, Portland; Michael A. Aveni, Lake Oswego, both of OR (US)

(73) Assignee: Nike, Inc., Beaverton, OR (US)

( * ) Notice: Subject to any disclaimer, the term of this patent is extended or adjusted under 35 U.S.C. 154(b) by 72 days.

(21) Appl. No.: 09/776,294

(22) Filed: Feb. 2, 2001

(51) Int. Cl.[7] ..... A43C 11/00
(52) U.S. Cl. ..... 36/50.1; 36/54; 36/128
(58) Field of Search ..... 36/50.1, 54, 55, 36/128

(56) References Cited

U.S. PATENT DOCUMENTS

| | | | |
|---|---|---|---|
| 660,284 | A | 10/1900 | Webber |
| 1,542,848 | A | 6/1925 | Barnes |
| 2,088,851 | A | 8/1937 | Gantenbein |
| 2,241,653 | A | 5/1941 | Weyenberg |
| 2,244,030 | A | 6/1941 | Teehan |
| 3,626,610 | A | 12/1971 | Dassler |
| 3,650,051 | A | 3/1972 | Sass |
| 4,080,745 | A | 3/1978 | Torrance |
| 4,255,876 | A | 3/1981 | Johnson |
| 4,308,672 | A | 1/1982 | Antonious |
| 4,370,818 | A | 2/1983 | Simoglou |
| 4,373,275 | A | 2/1983 | Lydiard |
| 4,517,753 | A | 5/1985 | Rosenbaum et al. |
| 4,616,432 | A | 10/1986 | Bunch et al. |
| 5,289,646 | A | 3/1994 | Kiyosawa |
| 5,337,493 | A | 8/1994 | Hill |
| 5,437,112 | A | 8/1995 | Johnston |
| D381,495 | S | 7/1997 | Avar |
| 5,826,354 | A | 10/1998 | Garbujo |

OTHER PUBLICATIONS

The Adidas Predator Boot, Football boot giving greater accuracy and control in receiving and passing the ball, Craig Johnston, Jun. 19, 1991.

"Nike Footwear Catalog," Fall 1994, published Nov. 1, 1993, (p. 60) Beaverton, Oregon.

"Nike Footwear Catalog," Late Spring 1997, published Sep. 1, 1996, (pp. 104, 107, ), Beaverton, Oregon.

"Nike Footwear Catalog," Holiday 1998, published Feb. 1, 1998 (pp. M119, M121, W13), Beaverton, Oregon.

"Nike Footwear Catalog," Late Spring 1999, published Sep. 1 1999, (pp. M14), Beaverton, Oregon.

"Nike Footwear Catalog," Spring 2000, published Jul. 1, 1999, (pp.101, 102), Beaverton, Oregon.

"Nike Footwear Catalog," Fall 2000, published Nov. 1, 1999, (p.44), Beaverton, Oregon.

"Nike Footwear Catalog," Spring 2001, published Jun. 1, 2000, (pp.87,89, 90 ), Beaverton, Oregon.

"Nike Footwear Catalog," Late Spring 2001, published Sep. 1, 2000, (pp. 90, 92,) Beaverton, Oregon.

"Nike Footwear Catalog," Fall 2001, published Nov. 1, 2000, (pp.30, 93, 98), Beaverton, Oregon.

"Nike Footwear Catalog," Holiday 2001, published Feb. 1, 2001, (pp.82, 83, 85), Beaverton, Oregon.

*Primary Examiner*—M. D. Patterson
*Assistant Examiner*—Troy Arnold
(74) *Attorney, Agent, or Firm*—Trask Britt, PC

(57) ABSTRACT

A sports shoe with an integral tongue and acing system. The shoe includes an upper which is formed of a lateral portion and a medial portion. The medial portion extends across into the lateral side of the shoe and is configured to be placed beneath a longitudinal edge of the lateral portion. A plurality of eyelets or apertures are formed in the shoe and arranged in three rows. Two of the rows are located in the medial portion of the shoe and one row is located in the lateral portion of the shoe. A lining is placed on the interior surface of the medial portion such that the first and second rows of apertures are not exposed to the interior of the shoe. Respective pathways are defined between corresponding apertures of the two rows of the medial portion and between the medial portion and the adjacent lining for the accommodation of a lace therethrough.

22 Claims, 4 Drawing Sheets

SPORTS SHOE WITH INTEGRAL TONGUE AND LACING SYSTEM

BACKGROUND OF THE INVENTION

1. Field of the Invention:

The present invention relates generally to a shoe, and more particularly to a shoe intended for use in sporting activities.

2. State of the Art:

A conventional shoe includes a shoe upper portion that is secured to a sole portion, e.g. a shoe upper that is secured to an outsole. The shoe upper typically includes two upper edges which are positioned spacedly and opposite one another to define an opening that is positioned centrally on the upper surface of the shoe. The opening extends in a longitudinal direction from the edge of the throat or foot opening of the shoe towards the front or toe area of the shoe. A row of holes or eyelets may be positioned to extend along each of the two respective upper edges. A lacing is conventionally passed in a predetermined configuration through the holes to interconnect the two upper edges of the shoe upper and secure the shoe to the wearer's foot. In conventional shoe constructions a tongue element is positioned within the opening. The tongue element is typically secured at its foremost edge to the toe portion of the shoe. In use, the tongue element is positioned intermediate the wearer's foot and the two upper edges of the shoe upper and the associated lacing configuration. In this position the tongue element retains the row of holes or eyelets and the associated lacing from contacting the wearer's foot and producing discomfort for the user.

Certain sporting activities, such as soccer, require a participant to forcefully bring his foot, and hence his shoe, into a kicking contact with an object, such as a ball. Many of these sporting activities place a premium on a participant's ability to skillfully adjust his kicking contact with the ball to as to control the trajectory and speed of the kicked ball. In conventional practice, the participant oftentimes utilizes the portion of a shoe covering the upper portion of the participant's foot to contact the ball during the act of kicking, e.g. that portion of the shoe proximate the medial top. In other instances the participant may utilize the outer side of the shoe. Sport enthusiasts, wearing conventional shoes have discovered that a typical tongue element and lacing system often interfere with a participant's ability to control a kicked ball. The combination of the tongue element, the shoe upper and the lacing produce a very uneven, irregular kicking surface on the shoe. The kicking portion of conventional sports shoes oftentimes defines contours, ridges and other surface irregularities which can significantly effect the trajectory of a ball which comes into a forceful contact with those irregularities. Furthermore, the association of the tongue element, the shoe upper and the lacing produces a shoe thickness composed of several layers of material. This is often the case since the shoe in this particular region is formed of various layers including the tongue and the medial and lateral portions of the shoe upper. The lateral and medial portions each has an edge which is positioned to overlap the tongue during the shoe's use. Furthermore the laces run both between the tongue and the medial and lateral portions as well as on top of the medial and lateral portions of the shoe upper themselves.

This type of layered structure creates a buffer region between the ball and the participant's foot which may adversely effect the sensitivity of the contact participant's foot with the ball. Due to the thick body of material interposed between the participant's foot and the ball, the participant may not be able to sense the movement of the ball over the shoe surface through the body of material to a sufficient degree to obtain the optimum "feel" of the ball. Maintenance of this "feel" is considered by many sports enthusiasts to be a critical requirement in obtaining optimum athletic performance. Furthermore, if a player intends to strike a ball with a particular portion of his or her foot, and a ridge or an unnatural contour in the shoe overlies the intended striking portion of the player's foot, the ridge or contour of the shoe may strike a ball sending it along a path other that which was intended by the player.

Additionally, the typical tongue and lacing system of sports shoes allows the tongue to shift and move during wear of the shoe. Such shifting may include the sagging of the tongue toward the toe section of the shoe, or it may include lateral shifting of the tongue to one side of the shoe or another. Shifting of the tongue often causes the shoe to be uncomfortable which at the very least becomes distracting to the wearer of the shoe. Additionally, for shoes intended to impact a ball, a shifting tongue can interfere with a player's ball control as described above.

Other discomforts may also arise in shoes which utilize standard lacing systems. For example, a standard lacing system which runs longitudinally down the center top portion of the wearer's foot often causes pain and discomfort when the shoe is aced tightly for stability. This is because a number of highly sensitive nerves are positioned in the top central portion of the foot rendering this portion of the foot highly sensitive. Standard lacing systems, in effect, create a pressure ridge by pulling the edge of the medial and lateral shoe portions, as well as the tongue, directly down onto the sensitive area of the foot. Such pain and discomfort is again distracting and takes away from the sporting experience.

Various constructions have been attempted to remedy the above issues. Some attempts have been made to provide a shoe wearer with more control and eliminate interference of the tongue and lacing system. Other efforts have been made to increase comfort. For example, in one type of soccer shoe, the area of the tongue proximate the throat or foot opening may include a flap portion that folds outward and downward to cover an area of the opening and lacing system. The lacing, and the tied portion in particular, is thereby covered by the flap, removing it from exposure to the ball. The use of such a flap is thought to aid in providing a better surface over a portion of the lacing, as well as help retain the tongue in its original position by keeping it from sagging toward the toe of the shoe. However, such a flap simply provides an additional layer of material between a player's foot and the ball. Additionally, a flapped or folded tongue does little to maintain the tongue in its original position with regard to lateral movement.

Another attempt to render sports shoes more comfortable while retaining stability is disclosed in U.S. Pat. No. 4,517,753 to Rosenbaum et al. The Rosenbaum patent describes what is known as a lateral lacing system. A lateral lacing system includes two rows of eyelets which are shifted toward the lateral side of the foot. Shifting the laces to the side of the foot inherently shifts the pressure points created by the lacing system laterally as well. Thus, the effectual pressure ridge is shifted away from the top of the foot to a less sensitive area of the foot thereby increasing comfort. Rosenbaum, implements a lateral lacing system, in part, for accommodation of a large tongue covering a major part of the wearer's foot and the tongue's proper attachment to the shoe. The large tongue is designed to increase comfort in that it simulates a smooth and soft inner shoe. However, with regard to a shoe designed for kicking, the use of a larger tongue simply increases the amount of material placed between the wearer's foot and the ball. Additionally, lateral lacing systems are often inconvenient in that it is more difficult for a wearer to lace and tie the laces at the outside edge of the foot than it is at the top of the foot.

In view of the shortcomings in the art, it would be advantageous to provide a sports shoe which allows a wearer to lace the shoe from a top position while providing the comfort and pressure relief of a lateral lacing system. It would also be advantageous to provide such a sport shoe for impacting with a ball wherein the amount of material formed over the foot and positioned between the foot and the ball is reduced. In minimizing the material placed over a wearer's foot, it would be advantageous to configure the material to reduce unwanted surface features so as to increase ball control for the player wearing the shoe.

BRIEF SUMMARY OF THE INVENTION

In accordance with one aspect of the invention a sports shoe is provided which includes a sole and an upper shell. The upper shell includes a medial portion and a lateral portion. In one embodiment three rows of apertures are formed through the upper shell with at least one row of apertures being formed in the lateral portion and at least one row of apertures or eyelets being formed in the medial portion.

Additionally the shoe may be formed to define a first row of first apertures and a second row of second apertures in the medial portion, with a respective pathway extending between selectively paired apertures of the first and second rows. A longitudinal edge of the lateral portion of the shoe upper may be laterally displaced from the center of the shoe as viewed from above. The medial portion may then be configured to extend across the center portion of the shoe and beneath the lateral portion forming an underlayment. Such a shoe may additionally include cleats formed in or attached to the sole of the shoe for enhanced traction on various playing surfaces, especially natural grass surfaces.

In a preferred construction a lining is placed adjacent the interior surface of the upper shell. The lining may be secured to the upper shell, but is left w ed along at least one region of the interface of the lining and the shell to define a pathway which extends from a first aperture to a second aperture.

In accordance with another aspect of the invention, a sports shoe is provided which includes a sole attached to a shell. The shell includes a heel portion, a toe portion, a medial portion and a lateral portion. The shell is defined to have a centerline extending substantially through the rearmost point of the heel portion and the foremost point of the toe portion. The lateral portion includes a longitudinal edge located laterally adjacent the centerline. The medial portion is configured to extend across the longitudinal centerline and beneath the longitudinal edge of the lateral portion. Three rows of apertures or eyelets are formed in the shell including at least one row adjacent the longitudinal edge and at least one row in the medial portion. Additional features may be incorporated as described herein.

A longitudinal edge may be formed in the lateral portion which is laterally displaced from the center of the shoe as viewed from above. The medial portion may then be configured to extend across the center portion of the shoe and beneath the lateral portion forming an underlayment.

Such a shoe may additionally include cleats formed in or attached to the sole of the shoe for enhanced traction on various playing surfaces.

In accordance with another aspect of the invention, a sports shoe is provided which includes a sole attached to a shell. The shell includes a heel portion, a toe portion, a medial portion and a lateral portion. The shell is defined to have a centerline extending substantially through the rearmost point of the heel portion and the foremost point of the toe portion. The lateral portion includes a longitudinal edge located laterally adjacent the centerline. The medial portion is configured to extend across the longitudinal centerline and beneath the longitudinal edge of the lateral portion. Three rows of apertures or eyelets are formed in the shell including at least one first row defined in the lateral portion adjacent its longitudinal edge, at least one second row in the medial portion and a third row in the lateral portion spacedly positioned from the first row. Additional features may be incorporated as described herein.

In accordance with yet another aspect of the invention, a method of configuring the lacing structure of a sports shoe is provided. The method includes providing a shoe having a medial portion and a lateral portion. A longitudinal centerline is defined to extend substantially through a rear most point of the shoe and a foremost point of the shoe. A longitudinal edge is formed in the lateral portion adjacent the centerline. A first row of eyelets or apertures is formed in the lateral portion adjacent the longitudinal edge. A second row of apertures is formed in the medial portion at a first distance from the longitudinal edge. A third row of apertures is formed in the medial portion at a second distance from the longitudinal edge. The second distance is dimensionally larger than the first distance. Each row is defined to include at least a foremost aperture and a second foremost aperture rearwardly displaced from the foremost aperture. The foremost apertures of the first and third rows are located such that they linearly aligned at a defined angle with respect to the longitudinal centerline. The foremost aperture of the second row is located to lie substantially along the longitudinal centerline. The second foremost apertures of the first and third rows are linearly aligned to be substantially parallel with the defined angle. The second foremost aperture of the second row is located to be forwardly displaced from the second foremost apertures of the first and third rows. Additional apertures may be included in each row and located in a pattern similar to that defined for the second foremost apertures.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
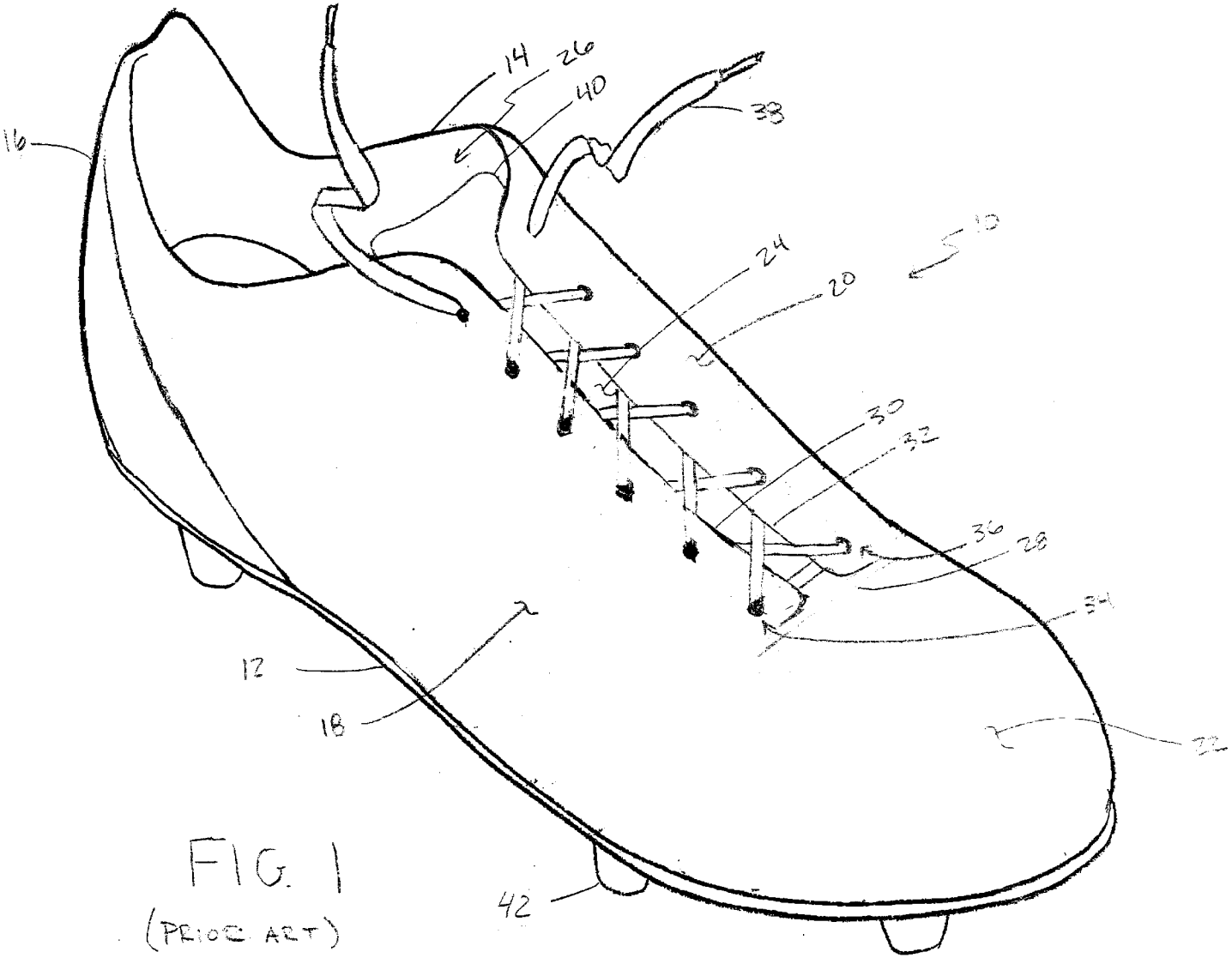
FIG. 1 (PRIOR ART)
FIG. 1 is an isometric view of the top portion of a prior art sports shoe.

Referring to FIG. 1, a typical sports shoe 10 is shown, and in particular a sports shoe utilized for impacting a ball such as in soccer. The shoe 10 includes an sole 12 (which may include a midsole secured to an outsole) which is secured to an upper portion 14. The upper portion 14 is comprised of a heel portion 16, a lateral portion 18, a medial portion 20 and a toe portion 22. The shoe 10 further includes an opening or slit 24 which may be U-shaped that extends centrally and in a longitudinal direction from the edge of the throat or foot opening 26 towards the front or toe area 22 to a leading edge 28. The opening 24 is formed by lateral edge 30 and a medial edge 32. Laterally adjacent the lateral edge 30 is a first row of apertures 34. Medially adjacent the medial edge 32 is a second row of eyelets or apertures 36. The rows of apertures 34 and 36 are configured to receive a lace 38 therethrough in a crisscrossing pattern for securing the shoe to the user's foot. A tongue 40 is positioned within the opening 24 and lies beneath the lateral and medial edges 30 and 32 and is secured to the leading edge 28, but remains unattached along each of its longitudinal edges. The tongue 40 is positioned to keep the rows of eyelets 34 and 36 and the lace 38 passing therethrough from contacting the wearer's foot. Cleats 42 are formed in, or attached to the sole 12 to enhance traction of the shoe 10 on various surfaces.

In certain sports, such as soccer, where the shoe 10 contacts a ball, e.g. proximal the medial top or outer side of the shoe, a typical tongue 40 and lacing system as described above may interfere with a player's control of the ball. This is often the case since the shoe 10 consists of various layers including the tongue 40, the lateral and medial edges 30 and 32 covering the tongue 40, and the ace 38 which runs both between the tongue 40 and the lateral and medial edges 30 and 32, as well as on top of the medial and lateral edges 30 and 32 of the shoe upper 14. This type of layered structure creates unwanted contours and ridges resting in unpredictability with regard to ball control. For example, if a player intends to strike a ball with a particular portion of his or her foot, and a ridge or an unnatural contour in the shoe overlies the intended striking portion of the player's foot, the ridge or contour of the shoe will strike a ball sending it along a path other than that which was intended by the player.

Additionally, the typical tongue 40 and lacing system of the sports shoe 10 allows the tongue 40 to shift and move during wear of the shoe 10. Such shifting may include the sagging of the tongue toward the toe section 22 of the shoe, or it may include shifting toward the lateral or medial side of the shoe 10. Shifting of the tongue 40 often causes the shoe 10 to be uncomfortable which at the very least becomes distracting to the wearer of the shoe 10. Additionally, for shoes intended to impact a ball, a shifting tongue can interfere with a player's ball control in a manner similar to that which has been described above.

Figure 2:
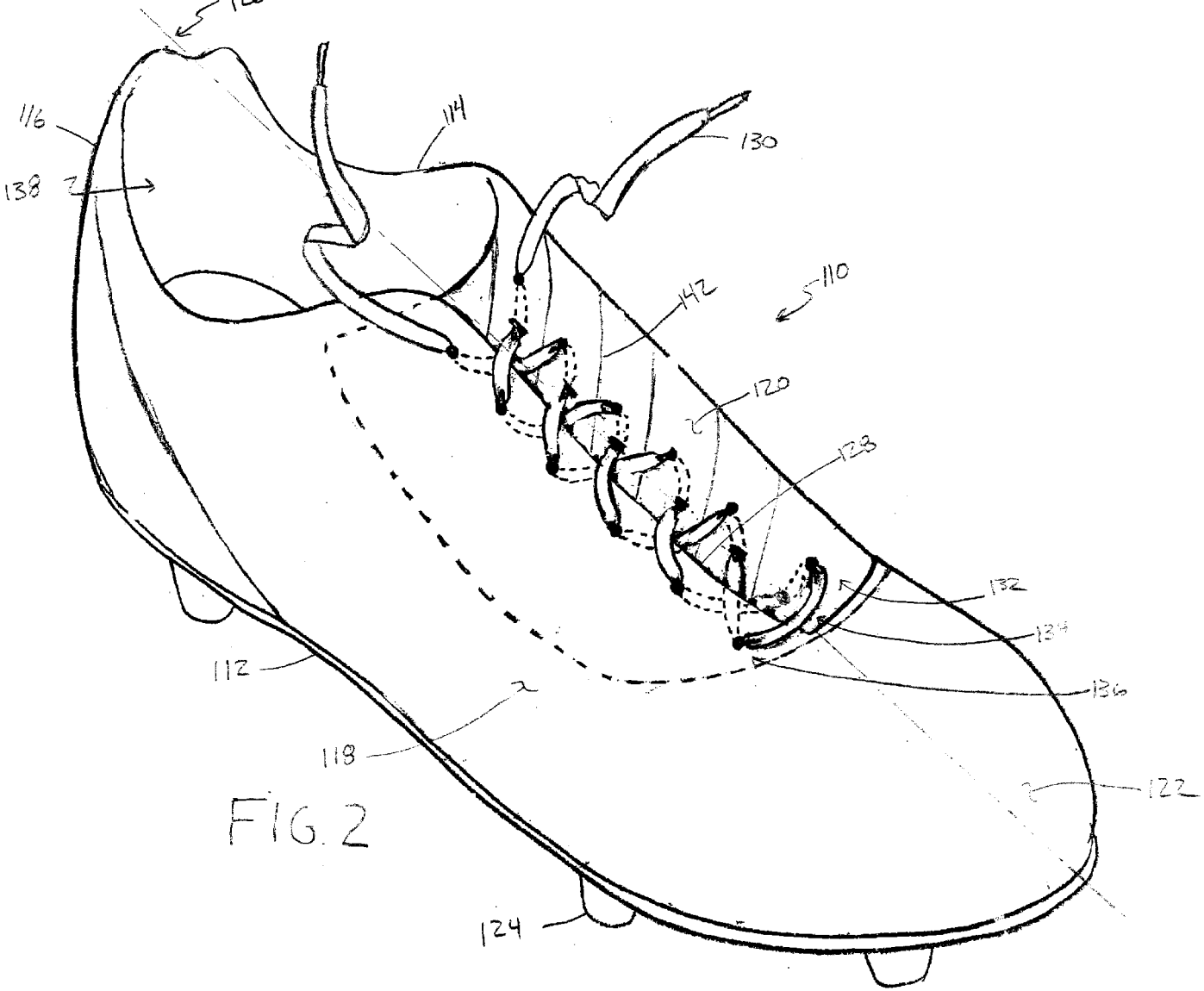
FIG. 2 is an isometric view of the top portion of a sports shoe according to one embodiment of the invention.
Figure 3:
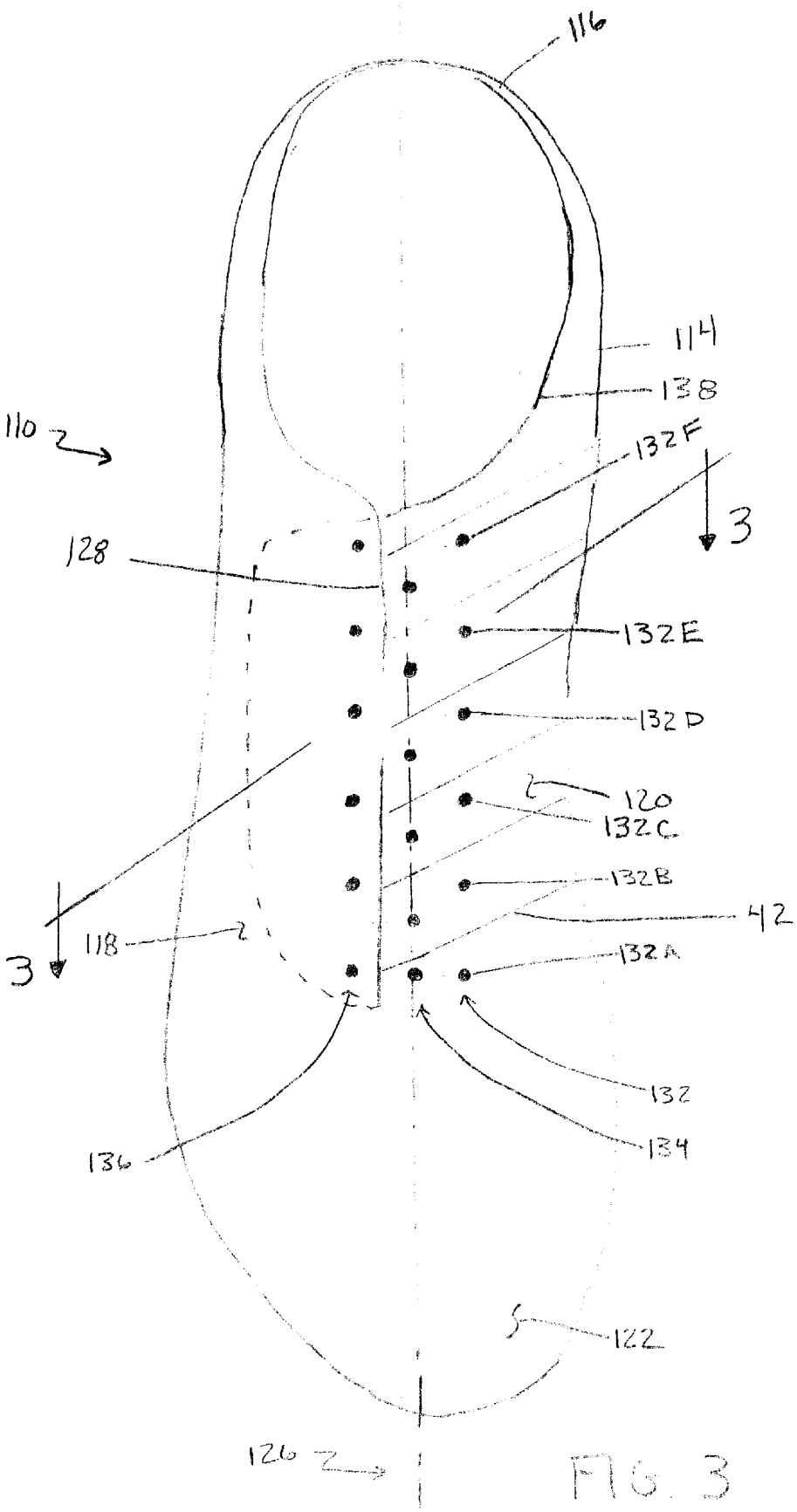
FIG. 3 is a top view of the shoe depicted in FIG. 1.
Figure 4:
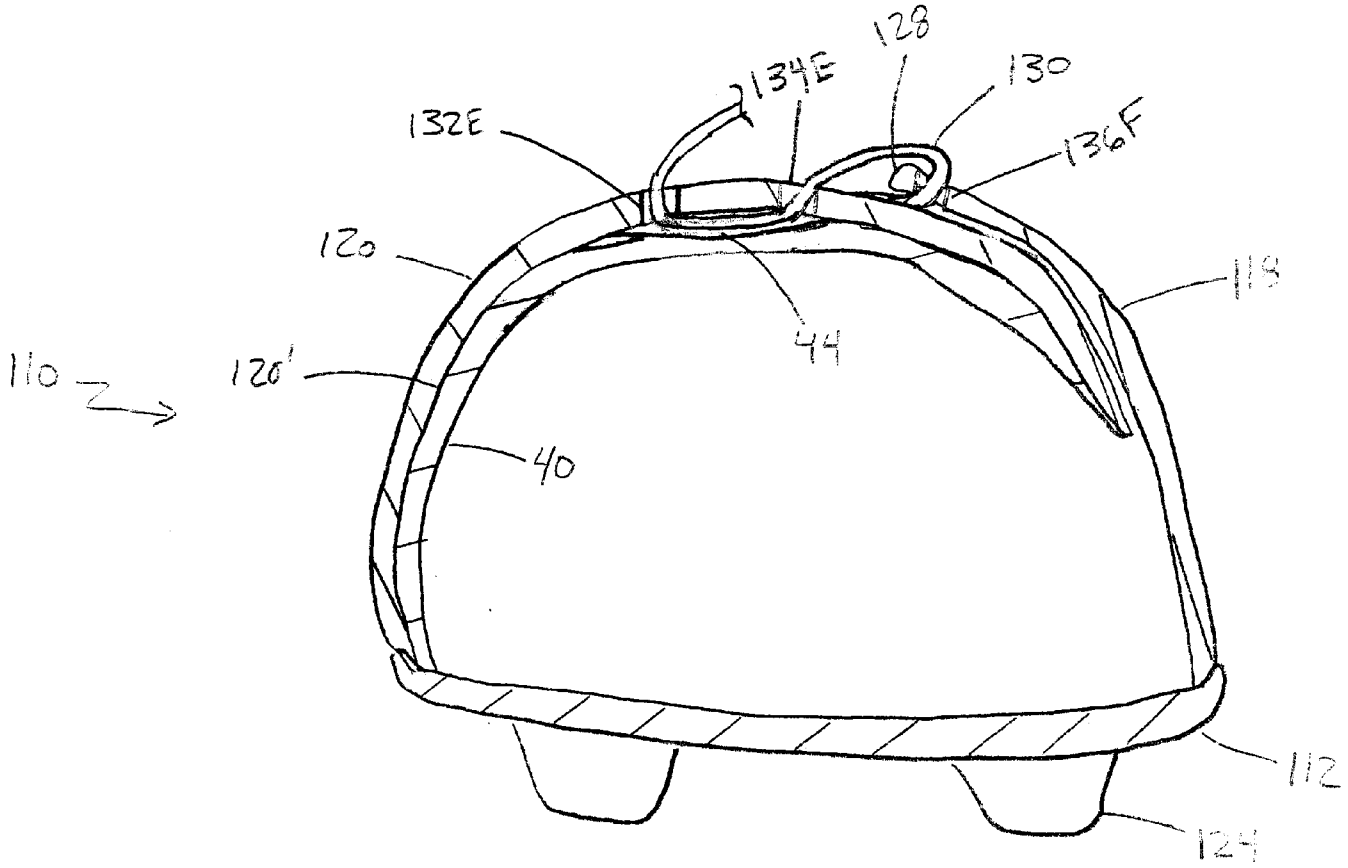
FIG. 4 is al view of the shoe depicted in FIG. 1.

Referring to FIG. 2, a sports shoe 110 is depicted in isometric view. The shoe 110 includes a sole portion 112 which may include a midsole (not shown) secured to an outsole. Attached to the sole 112 is the shoe upper 114, typically formed of supple leather or leather-like material, and which includes various components. The upper generally includes a counter or a heel portion 116, a lateral/vamp portion 118 (referred to herein as the lateral portion for convenience), a medial portion 120, and a toe portion 122. The shoe 110 also shows a plurality of cleats 124 attached to the sole 112. However, it is noted that various aspects of the present invention are applicable to shoes other than those which are cleated. The use of cleats 124 allows the wearer to obtain additional traction on playing surfaces such as grass or artificial turf as is understood by those of ordinary skill in the art. A cleatless sole, usefull for indoor surfaces, e.g., artificial turf, may also be utilized. It is noted that the shoe depicted in FIGS. 2–4 is shown as a low-cut shoe, meaning that the portion of the shoe upper 114 immediately adjacent the foot opening does not extend significantly above the ankle, if at all. However, this should not be taken as limiting the invention to the structure of a low-cut shoe. Shoes of other configurations, e.g. high top shoes may also be fitted with similar structure.

A centerline 126 is drawn through the shoe 110 for purposes of reference with regard to description of the shoe 110 an its various components. The centerline passes substantially through the rear most point of the heel portion 116 and the foremost point of the toe section 122.

A longitudinal edge 128 is formed in the lateral portion 118 on the lateral side of, and adjacent to the longitudinal centerline 126. The medial portion 120 extends across the centerline 126 and beneath the longitudinal edge 128 and toward the lateral side of the shoe 110 such that the lateral portion 118 overlays a segment of the medial portion 120. A lace 130 is provided for securing the shoe 110 to a player's foot.

The effect of extending the medial portion 120 and overlapping a segment thereof with the lateral portion 118 is that a traditional tongue is not required. Such an arrangement may be referred to as an integral tongue, or possibly a tongue-less shoe since the traditional tongue of a shoe is not utilized. Extending the medial portion 18 into the lateral side of the shoe 110 allows for an extraneous layer of material (the traditional tongue covered by a medial edge) to be removed from the shoe 110. It is noted, particularly with respect to a cleated shoe which may be used for impact with a ball, such as in soccer, that the layer of extraneous material has been eliminated on the medial and upper side of the shoe or player's foot. It is also noted that, while impact with the ball may take place at virtually any place on the shoe 110, the medial and upper side of the shoe form a primary kicking surface which receives more frequent contact with the ball than do other surfaces. Minimization of material in this primary impact area of the shoe serves to provide a player with an improved surface for impact with the ball thus improving ball control. In accordance with providing an improved primary kicking surface, the lace 130 is preferably formed as a thin flat lace such that it may be placed flat across the shoe upper 14 in the least obtrusive manner possible.

By arranging the lateral portion 118 and medal portion 120 in the above described manner, a unique lacing structure may be implemented to allow for greater stability and comfort of the shoe 110. The lacing structure additionally provides for a smoother kicking surface across the top of the shoe 110.

The lacing structure of the shoe 110 is described with reference to FIGS. 2 through 4. FIG. 3 is a top view of the shoe 110 without the lace 130 allowing for a clearer view of the configuration of apertures which serve as lacing eyelets. FIG. 4 depicts a cross sectional view of the shoe 110 as taken along section the section line indicated in FIG. 3. As seen in FIG. 2, the lace 130 is secured to the shoe 110 through a plurality of apertures or eyelets arranged in three rows 132, 134, and 136 running longitudinally along the upper portion of the shoe 110. As utilized herein, a "row" is used to indicate a series of features (i.e. apertures or eyelets) arranged in a generally linear fashion. Each row of apertures 132, 134 and 136 is shown to include six individual eyelets or apertures A-F (the individual apertures of row 132 are labeled in FIG. 3; for purpose of clarity rows 134 and 136 are not labeled in the drawings, however, they shall be referenced similarly herein with "A" being the aperture foremost on the shoe, "B" being the aperture next foremost and so forth). It is noted that, while each row is shown to have six apertures, the number of apertures may vary depending on, for example, the size of the shoe. Counter intuitively, the shoe uses more lace crossings than a traditional lacing pattern, such as seen in prior art FIG. 1. Having more, rather than fewer apertures (eyelets), facilitates the laces to be drawn tightly with less tendency to loosen during running, kicking etc.

The first and second rows of apertures 132 and 134 are located in the medial portion 120 of the shoe 110. The first row 132 is located medially adjacent the longitudinal centerline 126. The second row 134 is shown to lie substantially along the longitudinal centerline 126. However, depending on the size of a player's foot, such as the width or instep height of the foot, the medial portion 120 (as well as the lateral portion 118) may adjust inwardly or outwardly to accommodate such variations. If the medial portion 120 shifts inwardly or outwardly the rows of apertures 132 and 134 will accordingly shift with it. As such, the second row 134 may shift to one side or the other of the longitudinal centerline 126. However, since most of the adjustment will occur along the mouth or foot opening 138 of the shoe, the foremost aperture of the second row 134A will remain located substantially along the longitudinal centerline 126. The third row of apertures 136 is located in the lateral portion 118 of the shoe laterally adjacent the longitudinal edge 128.

The pattern of the apertures according to the described embodiment can be best seen with reference to FIG. 3. The foremost apertures of the first and third rows, i.e. 132A and 136A, define a line at a predetermined angle with respect to the longitudinal centerline 126. The line defined by apertures 132A and 134A is shown to be substantially perpendicular to the centerline 126, however the angle may be offset one way or another if so desired. Aperture 134A, the foremost aperture of the second row 134, is also shown to be aligned with apertures 132A and 136A. While such placement of aperture 134A is preferred, it is not necessary and may be alternatively located slightly forward or rearward of its shown position. The remaining apertures 134B–134F of the second row are shown to be forwardly offset from the corresponding apertures 132B –132F and 136B–136F of the first and third rows respectively. Thus, for example, apertures 132B and 136B define a line substantially parallel with the line of the foremost apertures 132A and 136B, while aperture 134B is forwardly displaced from corresponding apertures 132B and 136B. The apertures of the rows 132 and 136 are desirably spaced at approximately ⅝" to 11⁄16" from the next adjacent aperture within the same row (i.e., from aperture 132A to 132B). Aperture 134A is desirably spaced approximately ½" to 9⁄16" from aperture 134B, with the remaining apertures being spaced approximately ⅝" to 11⁄16" from one another. Row 132 is desirably spaced approximately ½" from row 134 (measuring the distance at a perpendicular angle from one from row 132). While, rows 134 and 136 may have a variable distance from one another depending on the size of the wearer's foot, aperture 134A is desirably spaced approximately 1" from aperture 136A with aperture 136A being approximately 5⁄16" to ⅜" from the longitudinal edge 128. Of course, these dimensions are not to be considered limiting as th depend, at least in part, on the size of the shoe.

The path of the lace 130 can be seen with reference to FIG. 2. Starting at re 132A, the lace travels in one direction beneath the medial portion 120 to aperture 134A From aperture 134A the lace 130 travels across the top of the medial portion 120, beneath the longitudinal edge 128 of the lateral portion 118 and through aperture 136B. From aperture 136B, the lace travels across the top of the longitudinal edge 128, through aperture 134C, beneath the medial portion 120 and back up through aperture 132C. The lace 130 continues in a similar pattern until it has passed through aperture 136F. Returning again to aperture 132A and following the lace 130 in the opposite direction, lace 130 travels across the top of the medial portion 118, across the top of the longitudinal edge 129 and through aperture 136A. From aperture 136A, the lace 130 travels beneath the lateral portion 118 and across the top of the medial portion 120 through aperture 134B. From aperture 134B the lace travels beneath the medial portion 120 through aperture 132B, back across the medial portion, beneath the longitudinal edge 128 and through aperture 136C. The lace continues in a similar pattern along this direction until it passes through aperture 132F.

The "triple" eyelet structure provides more crossings of the lace 130 and, as such provides a more uniform lace surface than occurs in a traditional soccer shoe, for example. Further, the outermost row 132 of apertures in the medial portion 120 provides a gradual adjustment of contour from the shoe surface to the lace surface.

In reference to the path of the lace 130, it has been described as passing beneath the medial portion 120 while traveling from one aperture to another. As seen in FIG. 4, an additional component helps to accomplish this without loss of comfort to the wearer of such a shoe 110. FIG. 4 shows the overlapping configuration of the lateral portion 118 with the medial portion 120. These components may be described generally as forming an outer or upper shell of the shoe. A lining 140 is placed adjacent the interior surface 120' of the medial portion. Thus, as the lace 130 passes from aperture 134E beneath the medial portion 120 and through aperture 132E, it passes between the interior surface 120' and the lining 140 such that it is kept from being exposed to the interior of the shoe or the wearer's foot. The lining 140 covers each aperture formed in the medial portion 120 of the shoe, but remains unattached between specified apertures forming pathways there between. It is noted that the materials used to form the shoe, including the medial portion 120, the lateral portion 118 and the lining 140, are formed of relatively thin material, and that FIG. 4 has been exaggerated in this respect to render a clearer view of individual components.

The lining 140 is preferably attached to the interior s adjacent to the pathways such as by stitching 142 as can be seen if FIGS. 2 and 3. Of course the lining could be adhered to the interior surface 120' of the shoe by other means such as adhesive or thermal bonding. The stitching 142 serves to form channels or tunnels 144 (seen in FIG. 4) for the lace 130 to pass through when securing the shoe 110 to a foot and thus preferably runs substantially parallel with the pathway of the lace as it extends from one aperture to another between the medial portion 120 and the lining 140. Additionally, the stitching 142 serves as a reinforcement to the aperture by which it is located. Thus, as the lace 130 pulls across the medial portion 118 of the shoe from an aperture (i.e. row 132) the stitching 142 acts as a structural support for the medial portion 120.

While the stitching 142 is shown to extend across a major area of the medial portion 120, it is contemplated that alternative stitching patterns may be used. Such alternatives, for example, may include placing stitching only immediately adjacent the apertures. Additionally, it is contemplated that the stitching may be serve as decorative stitching if so desired.

It is noted, that while the above disclosed shoe 110 has been shown and described as having a medial portion 120 extending beneath a longitudinal edge 128 and having two rows of apertures 132 and 134 therein, an alternative embodiment reversing this relationship may also be acceptable. For example, the medial portion 120 may be configured with a longitudinal edge which overlies the lateral portion 118. In such a case, a single row of apertures may be located in the medial portion 120 with the second and third rows of apertures being located in the lateral portion. The lacing pattern would inherently be reversed as well.

The lacing structure as described herein serves to accomplish several things. First, by Icing the shoe 110 in this manner, the major kicking area of the shoe 110 is kept cleaner with fewer layers of material between a player's foot and the ball in specific areas through removal of a traditional type tongue and its associated lace system.

Second, the layering of the lace 130, by extending one row of apertures further from the centerline 126, tends to make a smoother transition from the medial portion 120 to the longitudinal edge 128 through the use of a third row of apertures and the associated lacing pattern described herein which increases exposure of the lace in strategic areas. The transition can be seen in the lacing pattern which is accommodated by the additional row of apertures. For example, viewing the lace 130 as it traverses the medial portion 120 of the shoe from aperture 132C to 136D, it is seen that there is only on segment of lace 130 exposed between the first row 132 and the second row 134 (i.e., the segment of lace from aperture 132C to the point where is passes by aperture 134D). However, the next lace segment (i.e. continuing from the point where the lace passes by aperture 134D to 136D) runs beneath another lace segment (the segment passing from aperture 136C to 134D) creating a layered effect along the longitudinal edge 128. The lacing system thus provides a single segment of lace between rows 132 and 134, and doubled or layered segment of lace between row 134 and the longitudinal edge 128. This lacing transition helps to minimize the effect of the longitudinal edge 128 which would otherwise present a discontinuity across the top of the shoe. As noted previously, the transition adds to an improved kicking surface by providing a smoother surface over a larger area of the shoe 110.

Additionally, the lacing structure described herein provides the benefits of a lateral lacing system (i.e. the laces and eyelets placed on the lateral side of the shoe) while maintaining the physical location of the lacing system in the central portion of the shoe 10 making the shoe easier to tie and secure to one's foot. The benefits of a lateral lacing are largely that the pressure of induced by a tied shoe is carried on the side of the foot which is a less sensitive area. The present invention allows for pressure to be shifted and concentrated in a laterally displaced region of the shoe, more specifically along the row of apertures or eyelets adjacent the longitudinal edge 128 (i.e., row 136). The medial portion 120 is pulled across the foot with the pressure be concentrated laterally. Thus, rather than creating a pressure ridge along the center of the foot, such as in conventional lacing systems, the present invention shifts the pressure to a less sensitive area while maintaining a more conventional position of the ace 130 for tying.

Also, the described lacing structure better secures the shoe 110 to one's foot in that the lace 130, once properly laced and tied, tends to hold in place better with the lace being in contact with a greater overall surface area of the shoe (i.e. the lace contacts both the interior surface 120' and the lining and is pressed there between at numerous locations). The crossing and overlaying structure of the lace also adds to the secureness of the shoe once properly laced.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A sports shoe comprising:

a sole;

an upper shell attached to the sole having a medial portion and a lateral portion, the outer shell having three rows of apertures therethrough, a first row of apertures being defined in the medial portion and a second and third row of apertures being defined in the lateral portion, said second row of apertures defining a first aperture and said third row of apertures defining a second aperture; and a lining adjacent an interior surface of the upper shell, the lining in association with said upper shell defining at least one passageway there between extending from said first aperture to said second aperture.

2. The sports shoe of claim 1, further comprising a lacing passing through said apertures to interconnect said lateral portion to said medial portion.

3. The sports shoe of claim 1, wherein said second row of apertures defines a plurality of first apertures and said third row of apertures defines a plurality of second apertures, wherein the association of said upper shell with said lining defines a plurality of passageways, a respective passageway being defined between selected pairings of first and second apertures.

4. The sports shoe of claim 3, wherein said upper shell and said lining are secured to one another along each longitudinal edge of at least one said passageway.

5. The sports shoe of claim 3, wherein the shoe has a heel portion, a toe portion and a longitudinal centerline extending substantially from a rearmost point of the heel portion to a foremost point of the toe portion, and wherein the lateral portion includes a longitudinal edge adjacent the third row of apertures and laterally adjacent the longitudinal centerline.

6. The sports shoe of claim 5, wherein the medial portion extends across the longitudinal centerline and beneath the longitudinal edge of the lateral portion.

7. The sports shoe of claim 6, wherein the first row of apertures is medially adjacent the longitudinal centerline.

8. The sports shoe of claim 7, wherein the second row of apertures is located between the first row and third row and wherein the second row of apertures includes a foremost aperture located substantially along the longitudinal centerline.

9. The sports shoe of claim 8, further comprising a lace passing through the first aperture, along the pathway and through the second aperture.

10. The sports shoe of claim 9, further comprising at least one cleat on the sole.

11. The sports shoe of claim 1, wherein said lining is attached to the interior surface of the upper shell at least adjacent a first side of, and substantially parallel to, the at least one pathway.

12. The sports shoe of claim 11, wherein said lining is further attached adjacent to the interior surface of the upper shell along a second side of said pathway defining a channel between the outer shell and lining from the first aperture to the second aperture.

13. The sports shoe of claim 12, further comprising a lace extending through said channel.

14. A sports shoe comprising:

a sole;

an upper shell attached to the sole comprising: a heel portion, a toe portion, a medial portion, and a lateral portion, the upper shell having a longitudinal centerline extending substantially from a rearmost point of the heel portion through a foremost point of the toe portion, the lateral portion having a longitudinal edge located laterally adjacent the longitudinal centerline, the medial portion extending across the longitudinal centerline and beneath the longitudinal edge of the lateral portion; and the upper shell defining a first, second and a third row of apertures positioned substantially parallel with the longitudinal centerline and configured for receipt of a lace therethrough, at least one of the rows of apertures being located in the lateral portion and at least one of the rows of apertures being located in the medial portion.

15. The sports shoe of claim 14, wherein two of the three rows of apertures are located in the medial portion.

16. The sports shoe of claim 15, wherein the first row of apertures is located medially adjacent the longitudinal centerline.

17. The sports shoe of claim 16, wherein the second row of apertures includes a foremost aperture which is located substantially along the longitudinal centerline.

18. The sports shoe of claim 14, further comprising at least one cleat on the sole.

19. A method of configuring the lacing structure of a sports shoe comprising:

providing a shoe having a medial portion and a lateral portion;

defining a longitudinal centerline extending substantially through a rear most point of the shoe and a foremost point of the shoe;

forming a longitudinal edge in the lateral portion adjacent the longitudinal centerline;

forming a first row of apertures in the lateral portion adjacent the longitudinal centerline, the first row having at least a foremost aperture and a second foremost aperture rearwardly displaced from the foremost aperture;

forming a second row of apertures in the medial portion adjacent the longitudinal edge and at a first distance from the longitudinal edge, the first row having at least a foremost aperture and a second foremost aperture rearwardly displaced from the foremost aperture;

forming a third row of apertures in the medial portion adjacent the second row of apertures and at a second distance from the longitudinal edge, the second distance being greater than the first distance, the third row having at least a foremost aperture and a second foremost aperture rearwardly displaced from the foremost aperture;

locating the foremost aperture of the first and third rows in a linear fashion and at a defined angle with respect to the longitudinal centerline;

locating the foremost aperture of the second row substantially along the longitudinal centerline;

locating the second foremost aperture of the first and third rows in a linear fashion and substantially parallel with the defined angle; and locating a second foremost aperture of the second row forwardly from the second foremost apertures of the first and third rows.

20. The method of claim 19, further comprising locating the foremost aperture of the second row in a linear fashion with the foremost apertures of the first and third rows.

21. The method of claim 19, further comprising placing a linings t an interior surface of the medial portion such that the second and third row of apertures are not exposed to the interior of the shoe.

22. The method of claim 21, further comprising adhering the lining to the interior surface of the medial portion adjacent a linear pathway between an aperture in the second row of apertures and an aperture in the third row of apertures.

* * * * *